US005113047A

United States Patent [19]

Tsutsumi

[11] Patent Number: 5,113,047

[45] Date of Patent: May 12, 1992

[54] PUSHBUTTON SWITCH WITH WEAR PREVENTING GROOVE

[75] Inventor: Jyoji Tsutsumi, Iwaki, Japan

[73] Assignee: Alps Electric Co., Ltd., Tokyo, Japan

[21] Appl. No.: 492,273

[22] Filed: Mar. 7, 1990

Related U.S. Application Data

[63] Continuation of Ser. No. 282,541, Dec. 9, 1988, abandoned.

[30] Foreign Application Priority Data

Feb. 8, 1988 [JP] Japan ..... 63-14656[U]

[51] Int. Cl.[5] ..... H01H 5/18

[52] U.S. Cl. ..... 200/407; 200/406

[58] Field of Search ..... 200/406, 516, 407

[56] References Cited

U.S. PATENT DOCUMENTS

| | | | |
|---|---|---|---|
| 4,146,767 | 3/1979 | Murata | 200/406 |
| 4,385,218 | 5/1983 | Nishida | 200/406 |
| 4,398,074 | 8/1983 | Danielson et al. | 200/302. 2 |
| 4,463,233 | 7/1984 | Tanabe | 200/406 X |
| 4,484,042 | 11/1984 | Matsui | 200/406 |
| 4,913,285 | 4/1990 | Tsutsumi et al. | 200/406 |

*Primary Examiner*—Renee S. Luebke

*Attorney, Agent, or Firm*—Guy W. Shoup; B. Noël Kivlin

[57] ABSTRACT

A pushbutton switch includes a movable contact which effects an inverting motion in a case to get in and out of contact with a stationary contact to establish conduction and non-conduction of the switch. Grooves are provided along an inner bottom surface of the case so that free ends of the movable contact never scrape the inner bottom surface of the case upon an inverting motion of the movable contact.

1 Claim, 2 Drawing Sheets

PUSHBUTTON SWITCH WITH WEAR PREVENTING GROOVE

This application is a continuation of application Ser. No. 07/282,541, filed Dec. 9, 1988, abandoned.

FIELD OF THE INVENTION

This invention relates to a pushbutton switch for use in a car stereo, car radio, etc.

BACKGROUND OF THE INVENTION

A pushbutton switch of this type is disclosed in Japanese Utility Model Publication 58-164138A, and it is shown in a cross-sectional view of FIG. 6 of this application.

Referring to FIG. 6, reference numeral 1 designates a switch housing which is a synthetic resin mold in the form of a box opening at its upper end. Along an inner bottom surface la of the housing 1 are integrally provided stationary contacts 2*a*—2*a* and 2*b* in such a manner that their upper portions are exposed above the inner bottom surface 1*a*. Terminal extensions 3 extend from the stationary contacts 2*a*—2*a* and 2*b* to the exterior of the switch housing 1. Reference numeral 4 denotes a movable contact in the form of a dome-shaped leaf spring. The movable contact 4 is held in the switch housing 1 and overlies the inner bottom surface 1*a*. Parts of free ends 4*a* which form a peripheral margin of the movable contact 4 are located on the stationary contacts 2*a*—2*a*, and the movable contact 4 and the stationary contacts 2*a*—2*a* are held in continuous contact. Reference numeral 5 denotes a stem which is held in the switch housing 1 movably in the up-and-down direction. A projection 5*a* provided at the center of the lower surface of the stem 5 is held in contact with the top of the movable contact 4. Reference numeral 6 designates a cover which is clamped and fixed so as to overlie the upper opening of the switch housing 1 and has an aperture 6*a* which permits an upper projection of the stem 5 to project to the exterior of the switch housing 1 through the aperture 6*a*.

Under this arrangement, the prior art pushbutton switch operates as explained below.

As shown in FIG. 6, the stem 5 (shown by a solid line) is held in a close contact with the lower surface of the cover 6 by the movable contact 4 (shown by a solid line), and the central portion of the movable contact 4 remains apart from the stationary contact 2*b* located thereunder. Therefore, the stationary contacts 2*a*—2*a* are not in electrical conduction with the stationary contact 2*b*, namely, the switch exhibits its switch-off condition.

When the stem 5 is pushed down from the position of FIG. 6, the projection 5*a* of the stem 5 urges the top of the movable contact 4. Responsively, the movable contact 4 gradually yields downwardly, and it finally exhibits an inverted configuration. Then the movable contact 4 takes the configuration shown by a two-dot-and-dash line in FIG. 6 in which the top of the movable contact 4 contacts the stationary contact 2*b* thereunder and the stationary contacts 2*a*—2*a* and stationary contact 2*b* are electrically connected via the movable contact 4. Thus the switch exhibits its switch-on condition.

When the pushing force is removed from the stem 5, the movable contact 4, heretofore held in the inverted configuration shown by the two-dot-and-dash line in FIG. 6, demonstrates its revival force and restores its original configuration in which the top thereof is located at an upper position shown by the solid line. Thus the switch is returned to its switch-off condition.

The aforementioned prior art is configured to move the movable contact 4 into or out of contact with the stationary contact 2*b* thereunder by effecting inverting motions of the movable contact 4. However, in order to meet a recent demand of reduction in weight, thickness and length of pushbutton switches, the stationary contacts 2*a*—2*a* must not project upward so much from the inner bottom surface 1*a* of the switch housing 1. Therefore, when the top of the movable contact 4 invertingly moves into or out of contact with the central stationary contact 2*b* in response to up and down movements of the stem 5, free end portions of the movable contact 4 opposed to the inner bottom surface 1*a* often hit the inner bottom surface 1*a* and scrape off the inner bottom surface 1*a*. Scraped resin powder often causes unreliable electrical conduction between the contacts.

OBJECT OF THE INVENTION

It is therefore an object of the invention to provide a pushbutton switch which prevents scraping of the inner bottom surface of a case of the pushbutton switch and prevents unreliable electrical conduction between contacts.

SUMMARY OF THE INVENTION

In order to achieve the object, in a pushbutton switch in which stationary contacts are formed along an inner bottom surface of a case, the case also housing an invertible movable contact disposed over the stationary contacts so that a portion of the free ends of the movable contact are in contact with the stationary contacts, and in which the movable contact effects an inverting motion into or out of contact with the stationary contact, the invention has a particular arrangement in which grooves are provided along the inner bottom surface of the case at positions opposed to the parts of the free ends of the movable contact. Moveable contact not in contact with the stationary contacts.

By providing the grooves at positions where the free ends of the movable contact are exposed to the inner bottom surface of the case, the free ends of the movable contact do not hit the inner bottom surface of the case when the movable contact effects an inverting motion. Therefore, scraping of the inner bottom surface of the case in the prior art arrangement is prevented, and failure in electrical conduction between contacts never occurs.

DETAILED DESCRIPTION

Embodiments of the invention are explained below, referring to FIGS. 1 through 5.

Figure 1:
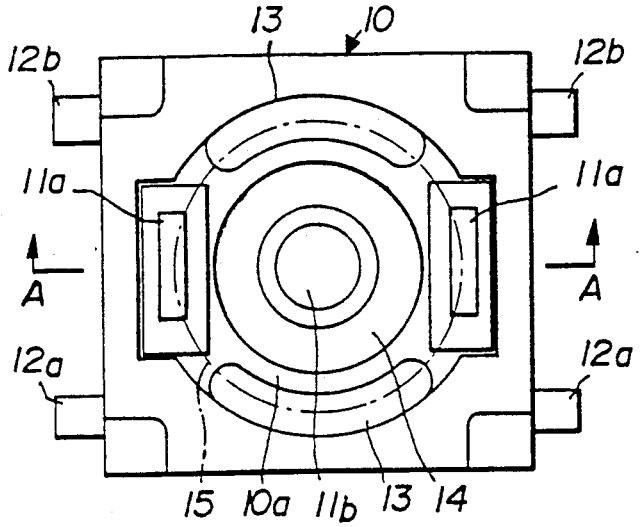
FIG. 1 is a plan view of a pushbutton switch taken as a first embodiment of the invention.
Figure 2:
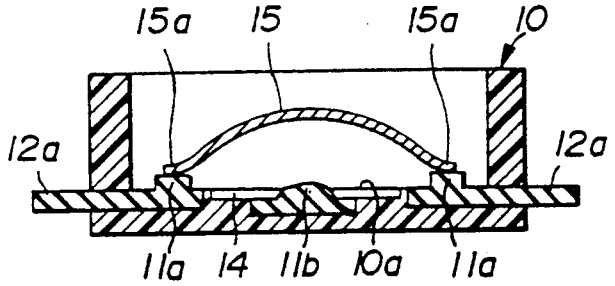
FIG. 2 is a cross-sectional view of the push-button switch of FIG. 1 taken along the A—A line.
Figure 3:
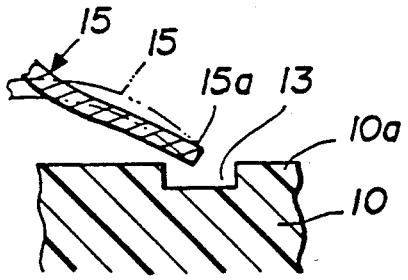
FIG. 3 is a fragmentary cross-sectional view showing the relationship between a free end of a movable contact and a groove both provided in the pushbutton switch of FIG. 1.

FIGS. 1 through 3 show a pushbutton switch taken as a first embodiment of the invention in which FIG. 1 is a plan view from which a cover and a stem are removed for a better insight into the interior of the switch, FIG. 2 is a cross-sectional view taken along the A—A line of FIG. 1, and FIG. 3 is a fragmentary cross-sectional view showing the relationship between a free end of a movable contact and a groove.

In these drawings, reference numeral 10 designates a case which is made from a synthetic resin in the form of a box opening at its upper end. Along an inner bottom surface 10*a* of the case 10 are exposedly provided stationary contacts 11*a*—11*a* and a central stationary contact 11*b* which are pressed into the form of projections from pieces of sheet material. These stationary contacts 11*a*—11*a* and 11*b* have terminals 12*a*—12*a* and 12*b*, respectively, which extend to the exterior of the case 10. The inner bottom surface 10*a* of the case 10 is provided with arcuate grooves 13—13 at positions between both stationary contacts 11*a*—11*a* where the inner bottom surface 10*a* confronts free ends of a movable contact (described later). The inner bottom surface 10*a* of the case 10 is also provided with an annular dust-reservoir recess 14 which encircles the central stationary contact 11*b*. Reference numeral 15 denotes a dome-shaped movable contact which is held in the case 10 and overlies the inner bottom surface 10*a*. Portions of free ends 15*a* which form the peripheral margin of the movable contact 15 are held in continuous contact with the stationary contacts 11*a*—11*a*, and the other portions of the free end 15*a* not in contact with the stationary contacts 11*a*—11*a* confronting the inner bottom surface 10*a* does not contact the inner bottom surface 10*a* because of the presence of the grooves 13—13 at corresponding positions. The movable contact 15 effects inverting motions under application or removal of an urging force to or from a stem (not shown) as in the prior art pushbutton switch so that it moves into or out of contact with the central stationary contact 11*b* located thereunder.

In the first embodiment having the above-described arrangement, when the movable contact 15 effects an inverting motion in response to a vertical movement of the stem, the free end 15*a*, although moving as if sweeping or scraping the inner bottom surface 10*a* of the case 10, actually moves in the grooves 13 and never hits the inner bottom surface 10*a*. Therefore, scraping of the inner bottom surface 10*a* of the case 10 is reliably prevented, and the contacts seldom fail to contact electrically with each other. Further, in the event that any resin powder is produced, the powder is received and held in the dust-reservoir recess 14 provided around the stationary contact 11*b* and seldom reaches the central stationary contact 11*b*. Thus the failure in electrical conduction with the movable contact 15 is prevented more reliably.

Figure 4:
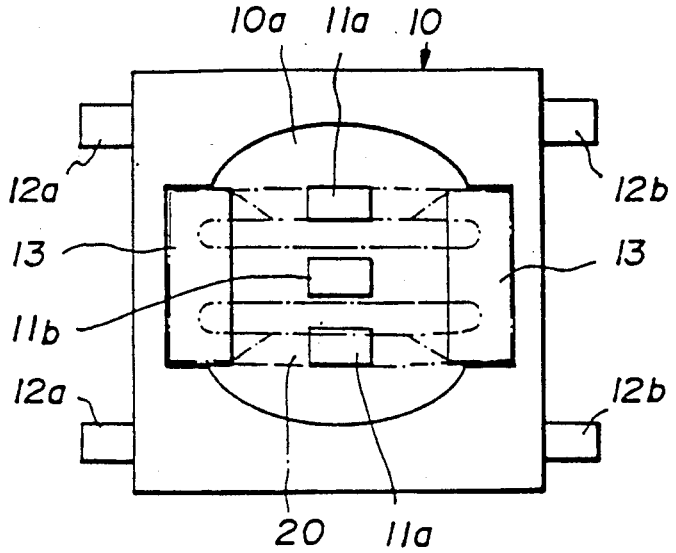
FIG. 4 is a plan view of another pushbutton switch taken as a second embodiment of the invention.
Figure 5:
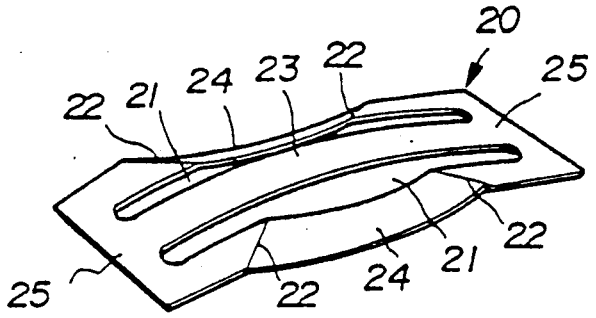
FIG. 5 is a perspective view of a movable contact of the pushbutton switch of FIG. 4.
Figure 6:
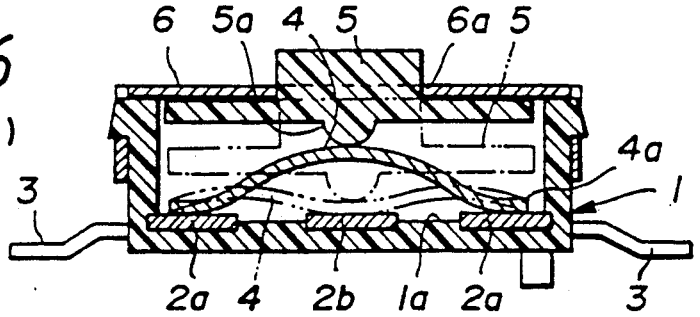
FIG. 6 (PRIOR ART)
FIG. 6 is a cross-sectional view of a prior art pushbutton switch.

FIGS. 4 and 5 show a pushbutton switch taken as a second embodiment of the invention in which FIG. 4 is a plan view from which a cover and a stem are removed for a better insight into the interior of the switch, and FIG. 5 is a perspective view of a movable contact. In these drawings, equivalent members or parts as those of the first embodiment are designated by the same reference numerals, and their detailed explanation is omitted.

The second embodiment uses a movable contact 20 in the form of a rectangular sheet. The movable contact 20 is made by providing a leaf spring with two slits 21, and consists of a central fragment 23 which effects inverting motions, and a pair of side fragments 24—24 which are bent downwardly along folding portions 22. Both side fragments 24—24 are held in continuous contact with the stationary contacts 11*a*—11*a* whereas the central fragment 23 effects an inverting motion into or out of contact with the central stationary contact 11*b* located thereunder in response to a vertical movement of the stem. The inner bottom surface 10*a* of the case 10 is provided with rectangular grooves 13—13 at positions confronting the free ends 25—25 which are opposite end margins of the movable contact 20.

In the second embodiment having the above-mentioned arrangement, when the free end 25 moves upon an inverting motion of the movable contact 20, the free end 25 only moves above the groove 13 and never hits or contacts the inner bottom surface 10*a* of the case. Therefore, the second embodiment gives the same result as that of the first embodiment.

As explained above, according to the invention, since the grooves are formed at selected positions of the inner bottom surface of the case exposed to parts of the free ends of the movable contact beyond the stationary contacts, movements of the free ends responsive to an inverting motion of the movable contact are limited to the interior of the grooves and the free ends never hit or contacts the inner bottom surface of the case. Therefore, the inner bottom surface of the case is never scraped off, and failure in electrical conduction between the contacts is prevented.

What is claimed is:

1. In a pushbutton switch including a case having a closed bottom wall, said closed bottom wall having an inside surface located inside said case, said case also having one or more side walls adjacent and substantially perpendicular to said bottom wall, at least one first stationary contact located on the inside surface of said bottom wall, a second stationary contact located on the inside surface of said bottom wall, said second stationary contact not adjoining said first stationary contact, a movable contact having a peripheral supporting edge having a first section adjacent the inside surface of said bottom wall and a second section abutting said first stationary contact, said movable contact also having a central portion capable of contacting said second stationary contact by resilient deformation, an improvement comprising:

the inside surface of said bottom wall defining at least one groove located directly adjacent said first section of said peripheral supporting edge such that said first section is suspended in or over said groove, thereby preventing said peripheral supporting edge from scraping along said inside surface of said bottom wall, the prevention of said scraping resulting in the prevention of a production of dust when said movable contact is deformed; wherein said movable contact comprises:

a flat rectangular leaf spring, wherein said peripheral supporting edge is divided into a pair of substantially parallel long edges defining a length and a pair of substantially parallel short edges defining a width, said leaf spring bent along said length to form an arc, said leaf spring defining a pair of substantially parallel slits disposed parallel to said long edges having ends adjacent said short edges, said pair of slits sectioning said leaf spring into a central fragment and a pair of side fragments, said central fragment capable of being deformed to contact said second stationary contact, and at least one of said side fragments being in contact with said first stationary contact;

wherein said short edges are disposed over said groove and said short edges do not contact said inside surface of said bottom wall.

* * * * *